United States Patent [19]

Marchini

[11] 4,404,058

[45] Sep. 13, 1983

[54] ROTARY SECTOR DEVICE TURNING AT A VARIABLE ANGULAR SPEED SUITABLE FOR THE WITHDRAWAL AND TRANSFERRING OF LABELS IN AUTOMATIC LABELLING MACHINES

[75] Inventor: Roberto Marchini, Marmirolo, Italy

[73] Assignee: O.C.E.A. S.r.l., Goito, Italy

[21] Appl. No.: 366,974

[22] Filed: Apr. 9, 1982

[30] Foreign Application Priority Data

Apr. 17, 1981 [IT] Italy ..... 18107 A/81

[51] Int. Cl.[3] ..... B65H 3/20

[52] U.S. Cl. ..... 156/571

[58] Field of Search ..... 156/568, 571

[56] References Cited

U.S. PATENT DOCUMENTS 3,567,559 3/1971 Dullinger ..... 156/212 X 4,060,229 11/1977 Carter ..... 156/571 X

*Primary Examiner*—David A. Simmons

*Attorney, Agent, or Firm*—Darby & Darby

[57] ABSTRACT

The invention relates to a rotary sector device turning at a variable angular speed for automatic labelling machines. Said device carries out the withdrawal of labels (6) from a container (5) acting as a magazine and the transferring of the same to an operating area where they are applied to the products for which they are meant (bottles, boxes, etc.).

Said device includes a plate (1) turning at a constant angular speed to which a plurality of rotary sectors (4) are mounted, each of said sectors turning about a corresponding vertical axis (A) at an angular speed varying according to a predetermined law of motion. This law of motion is accomplished by means of a toothed belt (27) kinematically connected to a circular pulley (36) coaxial to a corresponding rotary sector (4) and to a fixed asymmetric pulley (26), disposed in a central position with respect to the rotary plate (1). The suitable predetermined angular speed of a rotary sector (4) continually depends on the relative position between said rotary sector (4) and the fixed asymmetric pulley (26).

5 Claims, 3 Drawing Figures

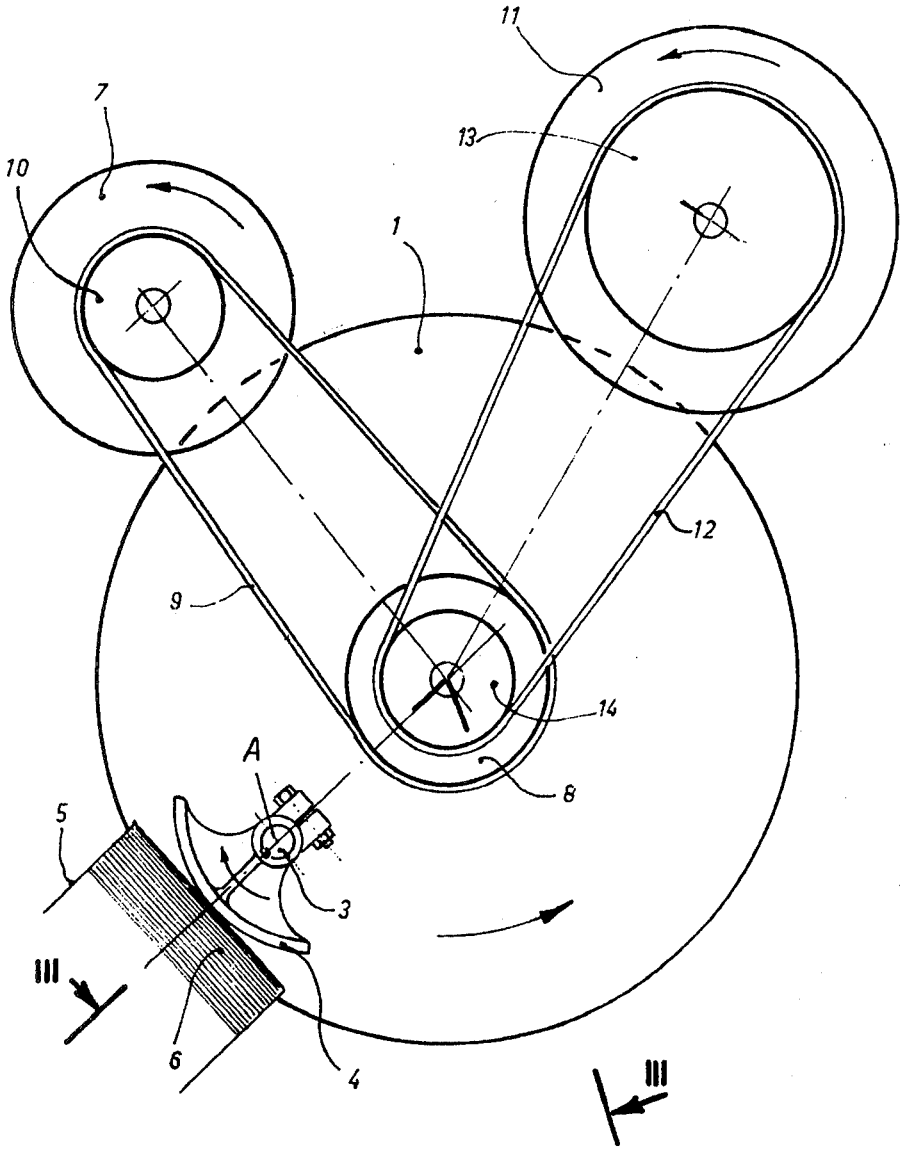
fig. 1)

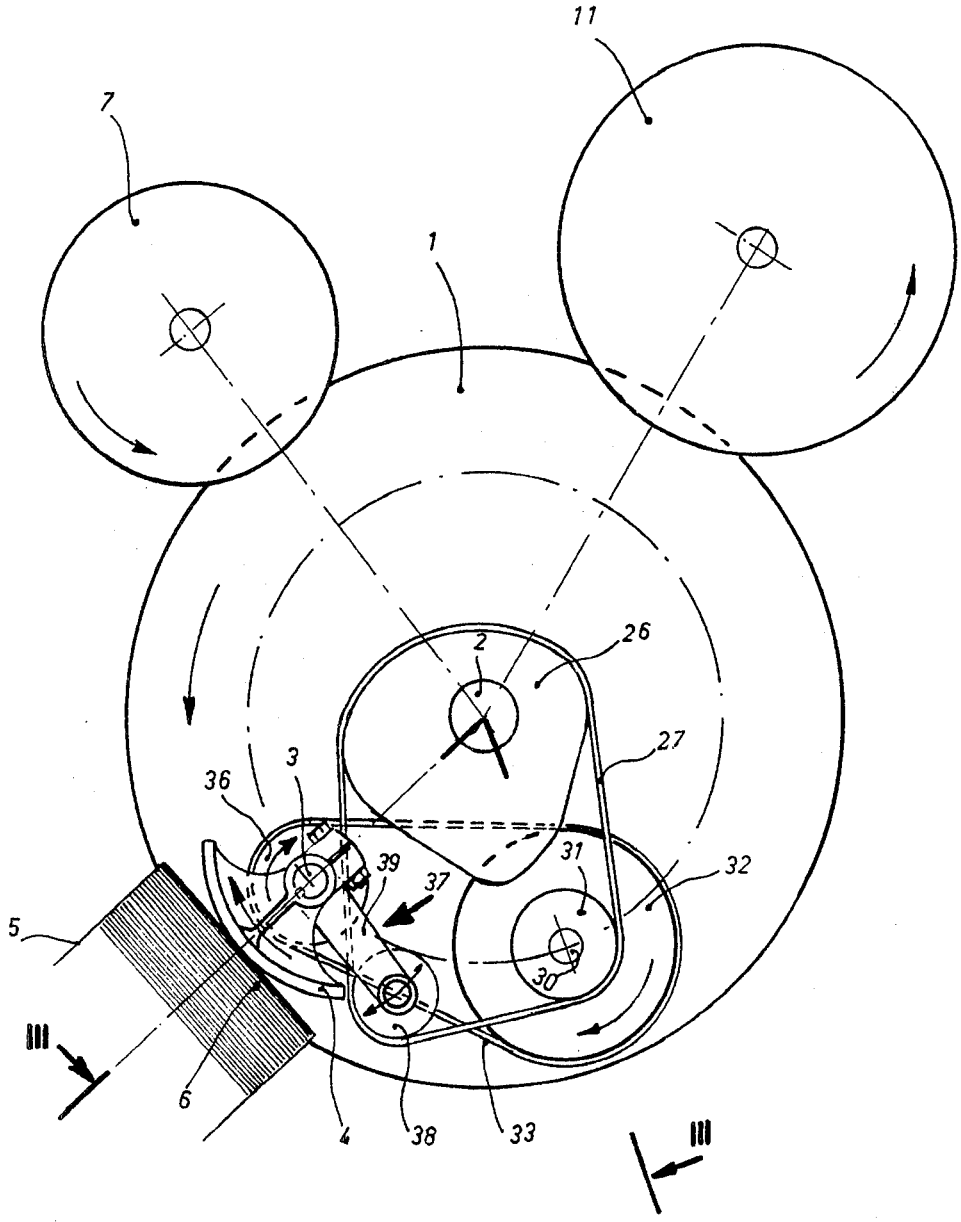
fig. 2)

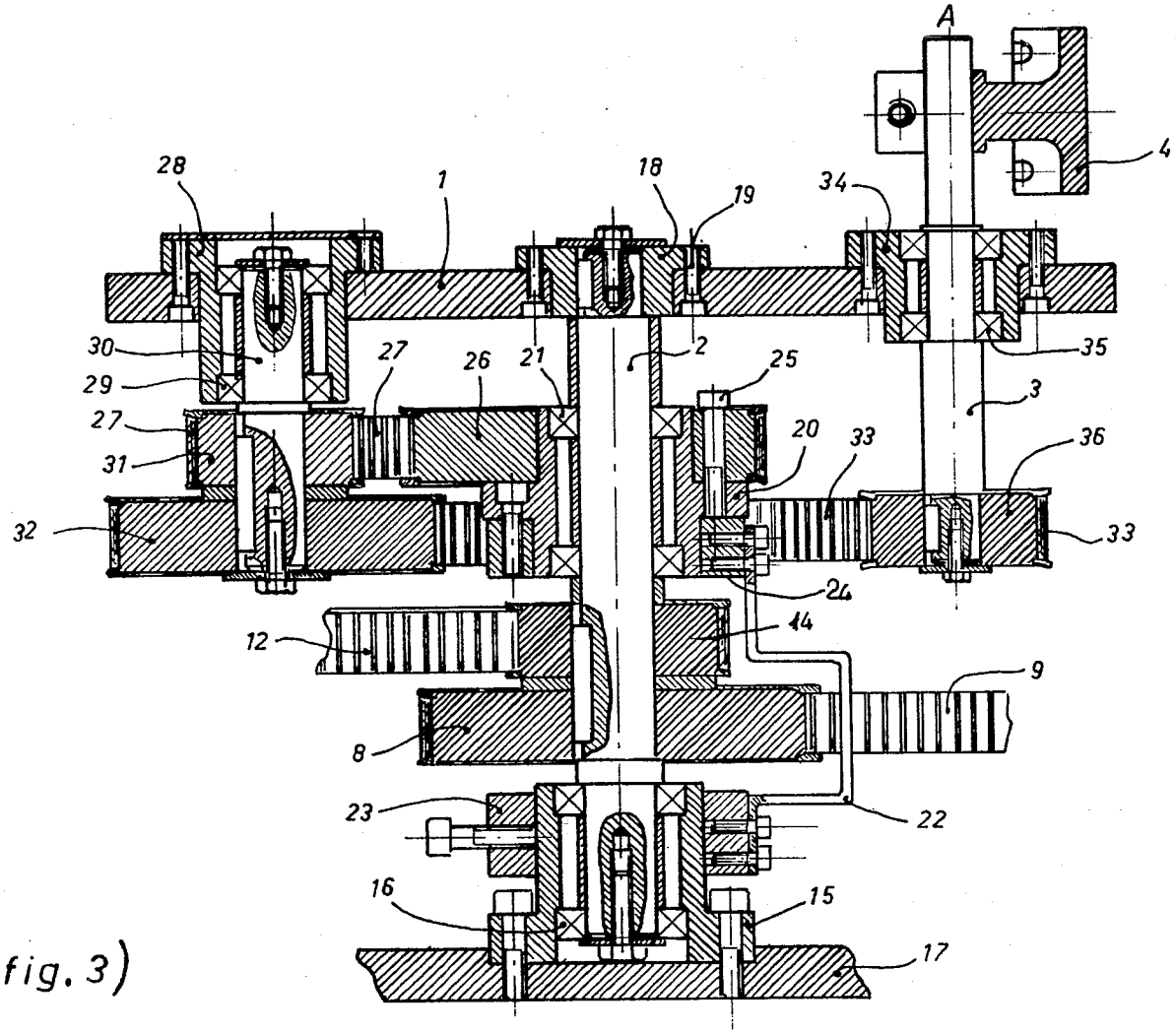
fig. 3)

ROTARY SECTOR DEVICE TURNING AT A VARIABLE ANGULAR SPEED SUITABLE FOR THE WITHDRAWAL AND TRANSFERRING OF LABELS IN AUTOMATIC LABELLING MACHINES

It is known that in middle and high speed automatic labelling machines, labels are disposed in a vertical position one after the other, in a stationary container acting as a magazine. At the front part of said container labels are only retained by small hooks situated along the periphery of the label. In this way the surface of the label, above all the opposed printed one, is uncovered. A pushing device causes the packet of labels to be always in abutment against the front hooks. Adjacent the label container is disposed a device including a vertical axis plate turning at a constant angular speed. A certain number of spindles (2–3–4–6 (etc.)) rises from said plate, each of said spindles supporting a rotary sector the outer surface of which is part of a cylindrical surface having the same sizes as the label housed in the magazine. During its moving each of said sectors comes into contact, along its whole surface, with a first cylindrical roller turning at a constant angular speed, on the outer surface of which is disposed a film of glue having a thickness of about the tenth part of a millimeter. The direction of rotation of said first roller is opposed to the direction of rotation of each sector.

In order that each sector receives the glue on the whole surface thereof, it is necessary that the contact between the surface of the sector and that of the first roller takes place at every moment: however, it must be a rolling contact, that is a contact without any sliding of surfaces. The vectorial sum of the speeds of the first roller, of the plate carrying the sectors and of said sectors must therefore be zero. In order to achieve this, each sector, for obvious kinematic reasons, must turn at a variable speed, on the portion in the vicinity of the first roller.

The rotary section on which a thin film of glue has been spread, must then roll without sliding on the label placed in the container in a static position. In this way the label will detach from the container and lay down on the rotary section surface. In this case too, the sector must turn at a variable angular speed. Then the label will be transferred, by means of the sector, to a second roller provided with mechanical pliers suitable to catch the same. Said second roller, which is a vertical axis roller too, will turn at a constant angular speed and in the opposite direction with respect to each sector. During this stage too, in order to avoid tearings on the label, the sector must turn without sliding on the roller provided with pliers. Therefore, in this case too the sector must have a variable angular speed.

The kinematic problem is therefore to make the surface of the rotary sector rotate without sliding on the surface of the two cylindrical rollers which have constant but different angular speeds and on a stationary flat surface, that is the labels in their container. According to the art hitherto known, the problem has been solved by utilizing epicyclic trains and two-track cams which cause the peripheral speed of the sector to vary in order to obtain the desired law of motion.

Such devices, however, have the following drawbacks:

They need a very accurate working of the gear wheels and the cams forming them. In fact the kinematic motion must be absolutely without backlashe as the presence of backlashe would give rise to a faulty withdrawal of labels and therefore to a bad labelling.

They need materials having high mechanical strength as the numerous gear wheels must have very reduced dimensions, due to lack of room.

They need a continual lubrication of the various kinematic mechanisms which therefore must have a bath of lubricant being closed in fluid tight sumps.

The above remarks make clear that the cost of these devices of the known art is very high.

The main object of the present invention is therefore to accomplish a rotary section device turning at a variable angular speed which is easy to make and has a reduced price, said device allowing the withdrawal of labels from a container acting as a magazine and the transferring of same to a working area where said labels are applied, while eliminating the drawbacks which may be found in known devices and which are due to the use of epicyclic trains including gear wheels and two-track cam utilized to obtain the law of motion in each rotary sector.

This and other objects are attained by the device of the present invention which is a rotary sector device turning at a variable angular speed suitable for the withdrawal and transferring of labels in automatic labelling machines, of the kind including a bearing plate, fitted on a vertical shaft, rotating at a constant angular speed, to which are mounted a plurality of rotary sectors, turning, each about a corresponding vertical axis, at a variable angular speed according to a predetermined law of motion, said rotary sectors coming sequentially into contact, by means of their curved side surface, with a first roller provided with glue turning at a constant angular speed, with a label disposed in a stationary container acting as a magazine and with a second roller, provided with pliers suitable for catching said label, turning at a constant angular speed, characterized in that said predetermined law of motion is produced by means of a toothed belt kinematically connected to a circular toothed pulley, coaxial to a corresponding rotary sector and fixed thereto, and to an asymmetric toothed pulley, fitted on said vertical shaft and fixed in place, the generating straight lines of the side surface of said asymmetric pulley being parallel to the longitudinal axis of said vertical shaft and spaced therefrom of a variable distance based on the angular speed changes provided for each of said rotary sectors according to the relative position of each of them with respect to said asymmetric pulley.

Further features and advantages of the invention will appear more evident from the following detailed description of a preferred embodiment given hereinafter by way of example only, with reference to the accompanying drawings, in which:

FIG. 1 is a plan diagrammatic view of the members connected to the device of the invention;

FIG. 2 is a plan diagrammatic view of the device of the invention;

FIG. 3 is a sectional view of the device, taken along the line III—III of FIGS. 1 and 2.

Referring to the drawings, it is indicated at 1 a bearing plate, fitted on a vertical shaft 2, turning at a constant angular speed. A plurality of spindles 3 (only one of them being indicated in the figures for the sake of simplicity), as mounted to the plate 1, on each of said spindles being fitted a rotary sector 4, turning about a vertical axis A at a variable angular speed and according to an opposite direction of rotation with respect to the bearing plate 1.

The outer side surface of each rotary sector is part of a cylindrical surface the axis of which is eccentric to the axis A of rotation of sector 4. At 5 is indicated a container acting as a magazine in which labels 6 are disposed in a vertical position. Peripherally to plate 1 there is one vertical axis cylindrical roller 7 turning at a constant angular speed and in the same direction as plate 1. The cylindrical outer surface of this roller 7 which is driven by a toothed pulley 8, fitted on plate 1, a toothed belt 9 and a toothed pulley 10 fitted on coaxially to the first roller 7, is covered with rubber and has a film of glue spread thereon, by means of known methods. Peripherally to plate 1 there is also a second vertical axis cylindrical roller 11 turning at a constant angular speed and in the same direction as plate 1. This roller 11 which is directly powered (in a manner known in itself and therefore not shown) transmists the motion to plate 1 and then to the first roller 7, through a toothed belt 12 mounted on a toothed pulley 13 coaxial to it and on a toothed pulley 14 coaxial to plate 1.

Referring particularly to FIG. 3, it is to be noted that the lower portion of the vertical shaft 2 is housed in one support 15 provided with ball bearings 16, which is fastened to a base 17. Keyed on shaft 2 there are: a toothed pulley 8 engaged with its respective belt 9; the toothed pulley 14 engaged with its respective belt 12; a flange 18 integral to plate 1 by means of securing screws 19.

A second support 20 provided with bearings 21 is disposed coaxially to the shaft 2 and is kept in a fixed position by means of a flange 22 integral to the first support 15 by means of a first ring 23 and to the second support 20 by means of a second ring 24. A pulley 26 is fixed, by means of screws 25, to the second support 20 the cylindrical side surface of which is not circular but asymmetric. This asymmetric pulley 26 engages with a corresponding toothed belt 27.

A third support 28 provided with bearings 29 and at the inside of which is housed a shaft 30, is fastened to the plate 1. Keyed on the lower portion of this shaft 30 there are a toothed pulley 31 with its respective belt 27 and a toothed pulley 32 (having a diameter suitably different from the one of pulley 31) connected to a corresponding belt 33. A fourth support 34 provided with bearings 35 and within which the spindle 3 rotates is also secured to plate 1, this support being suitably spaced from the third support 28.

On the upper portion of spindle 3 is fitted the rotary sector 4 while on the lower portion thereof is fitted a toothed pulley 36 connected to the belt 33.

Referring to FIG. 2, it is generally indicated at 37 a belt stretcher formed of a takeup pulley 38 mounted on an oscillating arm 39 which is pivoted on axis A.

The operation of the device described above is as follows.

Let us assume that the second roller 11 turns with a rotatory uniform motion. By means of the toothed pulley 13 fitted on the axis of roller 11, of the toothed belt 12, of the toothed pulley 14 fastened to the shaft 2 which carries the plate 1, such motion is transmitted to plate 1. By means of the pulley 8, belt 9 and pulley 10, motion is transmitted to the first roller 7. Therefore, the second roller 11, the plate 1 and the first roller 7 turn with a rotatory uniform motion. During its motion of rotation plate 1 drives the third support 28 and the shaft 30 housed therein. Shaft 30, because of the toothed pulley 31 meshing with the belt 27 connected to the asymmetric toothed pulley 26, receives a relative motion of rotation with respect to plate 1. This will not be a rotatory uniform motion but will follow a different law due to the peculiar profile of the outer surface of the asymmetric pulley 26 which can be obtained during the planning stage, according to the reciprocal position of rollers 7 and 11 and container 5.

In fact, by each infinitesimal angle $\alpha$ of rotation of plate 1 the belt 27 will wind on the asymmetric pulley 26 which is fixed, of a portion equal to $r \times \alpha$. As r is the radius of the asymmetric pulley 26 and as the latter is not circular, the value of r will not be constant but variable. Therefore also the portion of belt 27 winding on the asymmetric pulley 26 and consequently on pulley 31 will be variable with r. The right stretch of belt 27 will be obtained through the belt stretcher 37 which will follow the changes in position of belt 27.

The shaft 30, provided with rotatory motion at a variable angular speed with transmit such motion to the rotary sector 4 through pulley 32, belt 33, pulley 36 and spindle 3. Sector 4 will therefore have a rotatory motion relative to plate 1 and will turn at a variable angular speed, this speed following the same law as shaft 30, even if with a different absolute value due to the gear ratio existing between shaft 30 and spindle 3, owing to the presence of pulleys 31 and 32.

The peripheral surface of sector 4 will be provided with a motion, with respect to a person seeing the device from the outside, given by the composition of the rotatory uniform motion of plate 1 and the rotatory non-uniform motion of the asymmetric pulley 26. The profile of the asymmetric pulley 26 will be carried out so that the outer surface of sector 4 rolls without sliding on the first roller 7 in order to take up a thin film of glue, rolls without sliding on label 6 placed in the container 5 in order to catch it, and then rolls without sliding on the second roller 11 in order to allow the same to pick up said label by means of mechanical pliers not shown in the figures and to transfer it on the product for which it is meant (bottles, boxes, etc.).

The invention herein described may be embodied in other specific forms and particularly several modifications and changes can be carried out, such as, for instance, the removal of the two pulleys 31 and 32, so that the asymmetric pulley 26 is directly connected to pulley 36, without departing from the scope and spirit of the present invention.

I claim:

1. A rotary sector device turning at a variable angular speed suitable for the withdrawal and transferring of labels in automatic labelling machines, of the kind including a bearing plate (1), fitted on a vertical shaft (2), rotating at a constant angular speed, to which is integral a plurality of rotary sectors (4), turning, each about a corresponding vertical axis (A), at a variable angular speed according to a predetermined law of motion, said rotary sectors (4) coming sequentially into contact, by means of their curved side surface, with a first roller (7) provided with glue turning at a constant angular speed, with a label (6) disposed in a stationary container (5) acting as a magazine and with a second roller (11), provided with pliers suitable for catching said label (6) turning at a constant angular speed, characterized in that said predetermined law of motion is produced by means of a toothed belt (27) kinematically connected to a circular toothed pulley (36) coaxial to a corresponding rotary sector (4) and integral thereto, and to an asymmetric toothed pulley (26) fitted on said vertical shaft (2) and fixed in place, the generating straight lines of the side surface of said asymmetric pulley (26) being parallel to the longitudinal axis of said vertical shaft (2) and spaced therefrom of a variable distance based on the angular speed changes provided for each of said rotary sectors (4) according to the relative position of each of them with respect to said asymmetric pulley (26).

2. A device according to claim 1, characterized in that a belt stretcher (37) is provided in connection with each of said rotary sectors (4), said belt stretcher consisting of a takeup pulley (38) mounted on an oscillating arm (39) pivoted on the vertical axis (A) of said rotary sector (4) and being provided in order to take up the geometry variations in the position of said toothed belt (27) winding on said asymmetric pulley (26) during the rotation of said bearing plate (1).

3. A device according to claims 1 or 2, characterized in that a pair of coaxial circular toothed pulleys (31-32) are provided, said pulleys having different diameters and being integral to said bearing plate (1) and on them being respectively mounted a corresponding toothed belt (33), connected to said circular pulley (36), and said toothed belt (27) connected to the takeup pulley (38) and to the asymmetric pulley (26), said pair of toothed pulleys (31–32) carrying out an appropriate gear ratio between said circular pulley (36) and said asymmetric pulley (26), which allows to reduce the room occupied by the latter.

4. A device according to claims 1 or 2, characterized in that all the gear members consist of toothed belts kinematically meshing with toothed pulleys.

5. A device according to claim 3, characterized in that all gear members consist of toothed belts kinematically meshing with toothed pulleys.

* * * * *